US005800282A

United States Patent [19]

Hutin et al.

[11] Patent Number: 5,800,282

[45] Date of Patent: Sep. 1, 1998

[54] SET OF IRON-TYPE GOLF CLUB HEADS

[75] Inventors: Patrice Hutin; Roger Cleveland, both of Los Angeles; Daniel Joseph Stone; Joseph Lemus, III, both of Long Beach; John W. Goodin, Coto De Caza, all of Calif.

[73] Assignee: Roger Cleveland Golf Company, Inc., Cypress, Calif.

[21] Appl. No.: 642,532

[22] Filed: May 3, 1996

Related U.S. Application Data

[63] Continuation-in-part of Ser. No. 41,500, Jul. 17, 1995, Pat. No. Des. 375,769, Ser. No. 41,513, Jul. 17, 1995, Pat. No. Des. 379,646, and Ser. No. 48,708, Jan. 11, 1996, Pat. No. Des. 380,031.

[51] Int. Cl.[6] ..... A63B 53/04

[52] U.S. Cl. ..... 473/291; 473/324; 473/330; 473/331; 473/332; 473/305; 473/350

[58] Field of Search ..... 473/290, 291, 473/350, 324, 330, 331, 332, 305

[56] References Cited

U.S. PATENT DOCUMENTS

| | | | |
|---|---|---|---|
| D. 347,254 | 5/1994 | Iinuma . | |
| D. 354,326 | 1/1995 | Cleveland . | |
| D. 355,688 | 2/1995 | Cleveland . | |
| D. 366,082 | 1/1996 | Dekura . | |
| 3,947,041 | 3/1976 | Barber . | |
| 4,848,747 | 7/1989 | Fujimura et al. . | |
| 4,957,294 | 9/1990 | Long | 473/350 |
| 5,312,105 | 5/1994 | Cleveland . | |
| 5,316,298 | 5/1994 | Hutin et al. . | |
| 5,423,546 | 6/1995 | Manning et al. . | |

OTHER PUBLICATIONS

Trifecta Woods & Irons, *Golf Clubs*, p. 6. (Date Unkown).

Photographs of Cleveland 792T Irons. (Date Unknown).

*Primary Examiner*—George J. Marlo

*Attorney, Agent, or Firm*—Parkhurst & Wendel, L.L.P.

[57] ABSTRACT

A correlated set of iron-type golf club heads, wherein each head in the set employs the same sized vibration damping plaque. Each club head includes a substantially planar blade element having a front striking face for impacting a golf ball, and a rear surface opposite the front striking face. A perimeter weighting element is formed integrally with at least a portion of the outer perimeter of the rear surface and extends substantially rearwardly from the rear surface. The remainder of the rear surface not covered by the perimeter weighting element defines the bottom of an open cavity which is substantially surrounded by an inner peripheral surface of the perimeter weighting element. The area and shape of the remainder of the rear surface that defines the bottom of the open cavity are substantially identical in each club head of the correlated set, thus making it possible to use the same sized and shaped vibration damping plaque in each club head. The invention additionally includes an iron-type golf club head, including a top rail surface portion projecting rearwardly from an upper periphery of the front striking face and extending between the toe and heel portions. The hosel is offset and inset, and extends generally upwardly and forwardly only from the heel end portion of the top rail, such that the hosel does not occupy any portion of the front striking face and does not impede contact between the front striking face and a golf ball.

20 Claims, 3 Drawing Sheets

SET OF IRON-TYPE GOLF CLUB HEADS

This application is a Continuation-In-Part of U.S. patent applications Ser. Nos. 29/041,500 and 29/041,513, both filed Jul. 17, 1995, and Ser. No. 29/048,708, filed Jan. 11, 1996, now Design Pat. Nos. D375,769, D379,646 and D380,031, respectively.

BACKGROUND OF THE INVENTION

In the never-ending quest to make a golf club that can be used by every player, from the professional down to the beginner, the golf industry has introduced a large array of perimeter weighted clubs designed to provide relief from non-perfect or off-center hits. Applicants introduced the first golf club having vibration damping material to provide yet additional comfort to the player in the event of off-center hits.

U.S. Pat. No. 5,316,298, which is entirely incorporated herein by reference, discloses a vibration damping plaque on a surface of a golf club head to damp vibrations resulting from impact with a golf ball. It is extremely effective to position the vibration damping plaque on the rear surface of the golf club head to damp such vibrations. The plaque usually takes the shape of an oval and is smaller than the entire area of the rear surface of the club head.

Applicants also introduced the first golf club head that incorporated a hosel that was both offset from the face of the club head and inset from the heel of the club head to prevent twisting of the club head upon impact with a golf ball.

The inset/offset hosel design described in U.S. Pat. No. 5,312,105, which is entirely incorporated herein by reference, is effective in reducing twisting of the club head upon impact with a golf ball. However, since the hosel merges into the striking face of the club head, the hosel sometimes makes contact with the golf ball thus resulting in a so-called shank shot.

In view of the foregoing, there is room for improvement in both the vibration damping feature described in U.S. Pat. No. 5,316,298 and the hosel feature described in U.S. Pat. No. 5,312,105.

SUMMARY OF THE INVENTION

A first object of the present invention is to provide a correlated set of golf club heads, wherein each head in the set employs the same sized vibration damping plaque. More specifically, it is an object of the present invention to provide a correlated set of irontype golf club heads, wherein each head comprises a substantially planar blade element having a front striking face for impacting a golf ball, and a rear surface opposite the front striking face. A perimeter weighting element is formed integrally with at least a portion of the outer perimeter of the rear surface and extends substantially rearwardly from that outer perimeter. The remainder of the rear surface not covered by the perimeter weighting element defines the bottom of an open cavity which is substantially surrounded by an inner peripheral surface of the perimeter weighting element. An hosel extends from an upper heel region of the head for connection to a shaft. The area and shape of the remainder of the rear surface that defines the bottom of the open cavity are substantially identical in each club head of the correlated set.

Another object of the present invention is to provide a golf club head that resists twisting upon offcenter hits with a golf ball, as in U.S. Pat. No. 5,312,105, but also minimizes contact between the hosel and a golf ball during impact.

More specifically, it is an object of the present invention to provide an irontype golf club head, comprising a front striking face for impacting a golf ball, a rear surface opposite the front striking face, a toe portion, an heel portion opposite the toe portion, and a top rail surface portion projecting rearwardly from an upper periphery of the front striking face and extending between the toe and heel portions. An hosel, including a bore for receiving a shaft, is offset such that an extension of the axis of the bore intersects the front striking face or an extension of the plane thereof, and is inset such that the axis of the bore is spaced inwardly from the exterior of the heel portion. The hosel extends generally upwardly and forwardly only from the heel end portion of the top rail surface portion such that the hosel does not occupy any portion of the front striking face and does not impede contact between the front striking face and a golf ball.

DETAILED DESCRIPTION OF THE INVENTION

Figure 1:
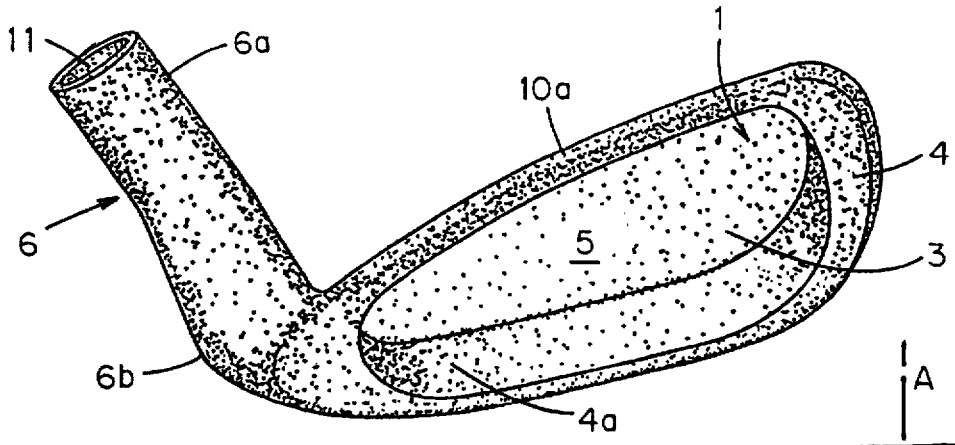
FIG. 1 is a rear perspective view of a golf club head according to the present invention.

FIGS. 1–4 show one club head of the correlated set of iron-type golf club heads according to the present invention. Each golf club head includes a substantially planar blade element 1 having a front striking face 2 for impacting a golf ball and a rear surface 3 opposite front striking face 2. Both front striking face 2 and rear surface 3 are substantially planar. A perimeter weighting element 4 is formed integrally with at least a portion of the outer perimeter of rear surface 3 and extends substantially rearwardly from that rear surface. The boundary between blade element 1 and perimeter weighting element 4 is shown by a line 10*a* in FIG. 4, although those elements are usually integrally cast as a single piece club head. The remainder of rear surface 3 that is not covered by perimeter weighting element 4 defines the bottom of an open cavity 5 which is substantially surrounded by an inner peripheral surface 4*a* of perimeter weighting element 4. An hosel 6 extends from an upper heel end portion 7 of a top rail 10 of the head for connection to a shaft 8.

It is preferred that perimeter weighting element 4 be substantially ring-shaped and extends around the entire outer perimeter of rear surface 3, although portions thereof could be removed to redistribute club head weight. It is also preferred that perimeter weighting element 4 has a substantially planar back surface 4*b* such that the entirety of that surface 4*b* lies in substantially the same plane, and an upward extension of that plane intersects an upward extension of the plane of front striking face 2.

The area and shape of rear surface 3 that is not covered by perimeter weighting element 4 are substantially identical in each club head of the correlated set. Although each club of the correlated set has the same general appearance and the cavity 5 in each club head has the same size and shape, the lateral width of perimeter weighting element 4, the lateral position of cavity 5, and the thickness of blade element 1 in each club head can be changed to distribute weight to various positions on the club head.

Figure 3:
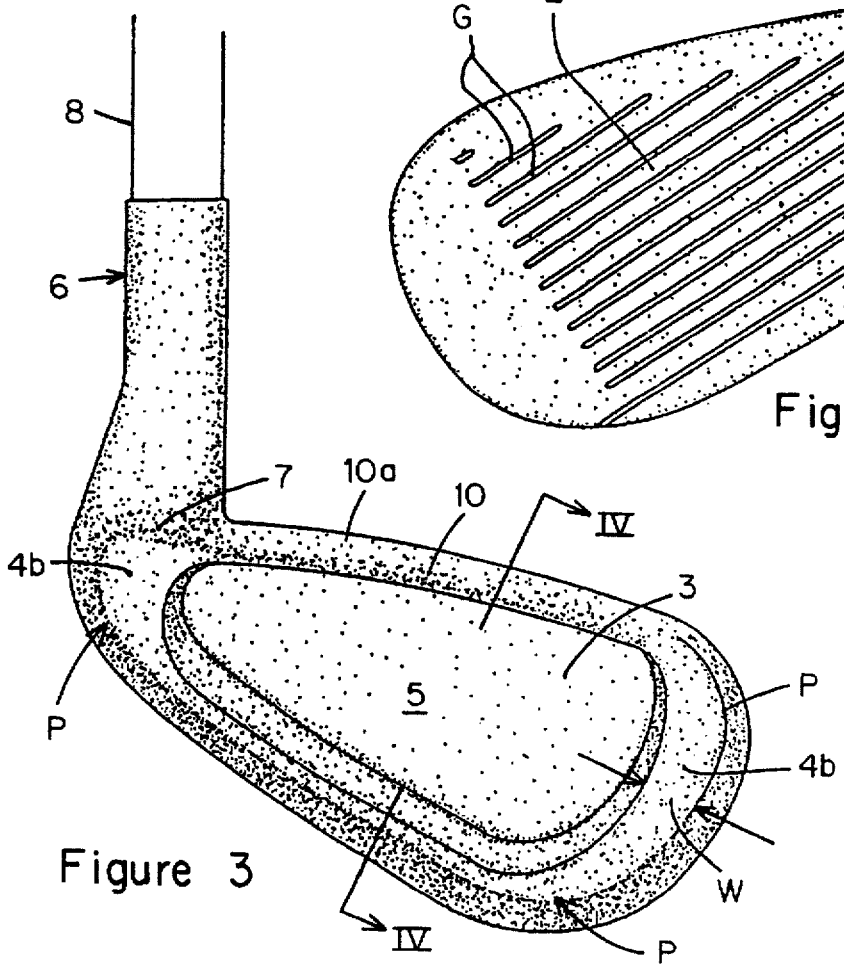
FIG. 3 is a rear view of the golf club head shown in FIG. 1.

For example, the lateral width "w" in FIG. 3 of perimeter weighting element 4, measured in a direction substantially parallel to blade element 1 at the same location on the periphery of each club head, can be different for each club head of the correlated set. The lateral position of cavity 5, relative to an outer peripheral surface P of perimeter weighting element 4 at the same location on the periphery of each club head, can be different for each club head of the correlated set. These features permit the weight of perimeter weighting element 4 to be shifted toward any one of the top rail, sole, toe or heel regions of the club head, depending on the loft angle of the particular club (e.g., a 3-iron could be more toe weighted than a 9-iron).

Figure 4:
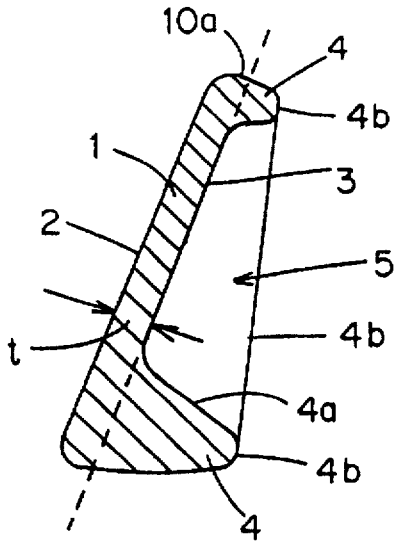
FIG. 4 is a cross-sectional view taken along line IV—IV of FIG. 3.

Additionally, the thickness "t" in FIG. 4 of blade element 1, measured between front striking face 2 and the remainder of rear surface 3 that is not covered by perimeter weighting element 4, can be different for each club head of the correlated set, to provide more or less club head weight in the center of the club.

It is preferred that inner peripheral surface 4a of perimeter weighting element 4 merges smoothly with rear surface 3. Inner peripheral surface 4a can be perpendicular to, or form an obtuse angle with rear surface 3. FIG. 4 shows that, by providing an obtuse angle between inner peripheral surface 4a and rear surface 3, more of the perimeter weighting element may be positioned further away from the center of gravity of the club head, thus making the club more forgiving with off-center shots.

Figure 5:
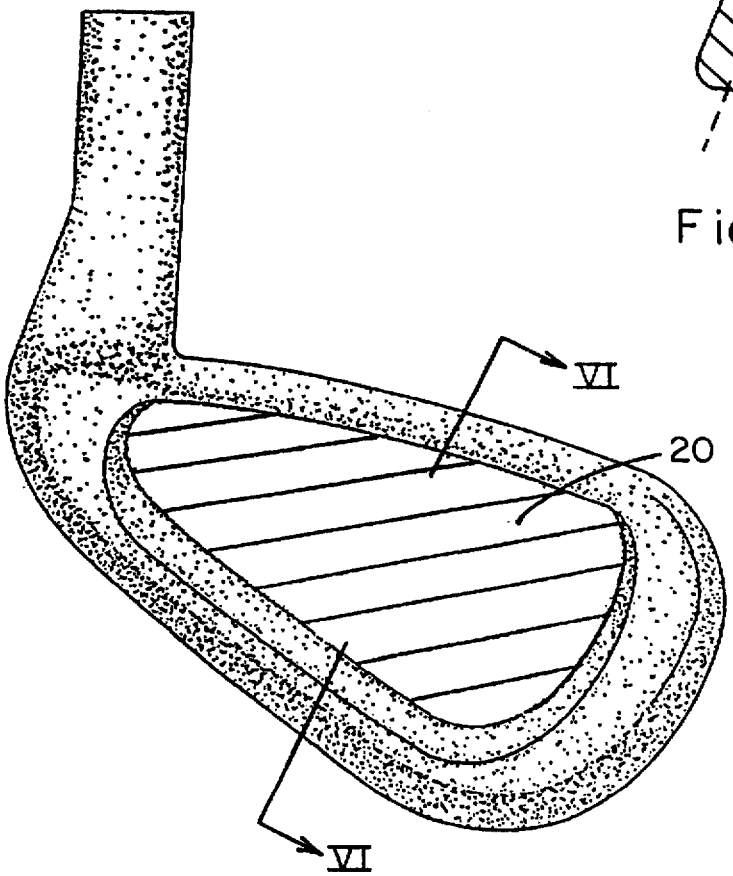
FIG. 5 is a rear view of a golf club head according to another embodiment of the present invention.
Figure 6:
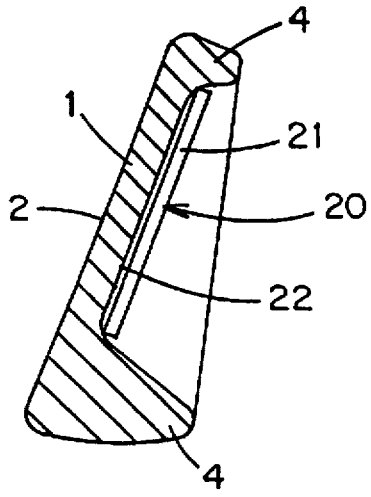
FIG. 6 is a cross-sectional view taken along line VI—VI of FIG. 5.
Figure 7:
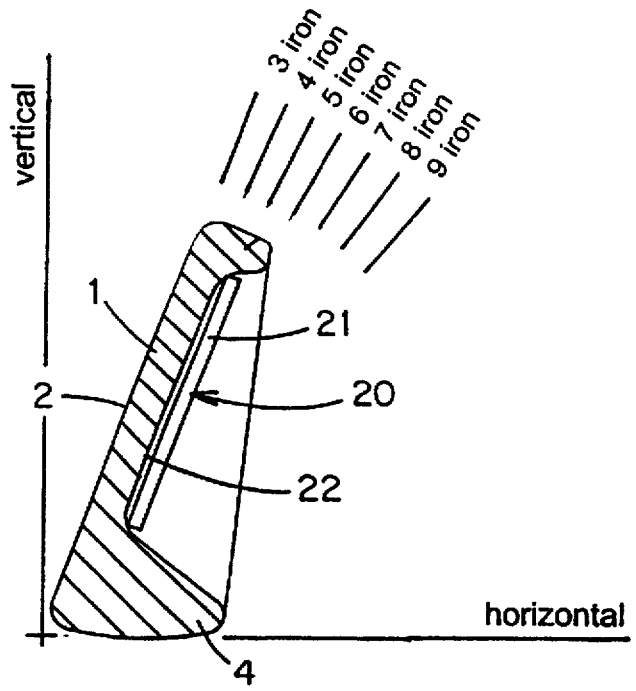
FIG. 7 schematically indicates a correlated set, here 3-iron through 9-iron, of iron-type golf club heads according to the present invention.

FIGS. 5 and 6 show another embodiment of the invention, wherein the club head of FIGS. 1–4 includes a vibration damping plaque 20 that occupies the entirety of the remainder of rear surface 3 that is not covered by perimeter weighting element 4. The damping provided by plaque 20 is maximized, because it occupies the entire available surface area of rear surface 3. The larger plaque also provides more room for descriptive information, such as logos.

Further, the size and shape of plaque 20 on each and every club head of the correlated set are the same, because the size and shape of the cavity of each and every club head of the set are the same. Accordingly, the plaques used on all clubs of the set are identical, thus making mass production of the clubs much more efficient and economical. Assuming it is desired to adjust final club head weight/mass using the plaques, the mass of each plaque can be changed accordingly. For example, the plaques can be made in groups, wherein the plaques in each group have the same mass. Mass production of the plaques is still facilitated by the fact that the size and shape of each plaque are identical, mass being the only variable for the plaques used on all club heads of a correlated set.

The damping effect of a vibration damping plaque is improved when the plaque occupies the entire rear surface of the club head. Since the rear surfaces of golf club heads, especially perimeter-weighted or cavity-backed heads, changes in size and shape from club-to-club in a given set, heretofore it has not been practical from a manufacturing standpoint to make numerous plaques of differing sizes and shapes and then match those plaques to each club separately. Moreover, if it is desired to use the plaque to provide the final end weight/mass of the club head, then yet another variable (in addition to size and shape) is introduced into the plaque, adding yet another group of plaques that would have to be made and separately matched to each club head.

The basic structure and function of plaque 20 are the same as the plaque described in U.S. Pat. No. 5,316,298. FIG. 6 shows that plaque 20 includes a constraining layer 21 secured to rear surface 3 via a layer 22 of vibration damping material. The constraining layer 21 is preferably a rigid plate having a Young's modulus of at least 10,000 MPa, more preferably at least 40,000 MPa, most preferably 60,000 MPa. Exemplary constraining layer materials include aluminum alloys, aluminum-zinc-magnesium alloys, laminated heat-setting materials reinforced with carbon fibers, laminated heat-setting materials reinforced with glass fibers, thermoplastics reinforced with carbon fibers, and thermoplastics reinforced with glass fibers. ZICRAL is an example of a material that works particularly well as a constraining layer. The thickness of constraining layer 21 preferably is 0.05–2.0 mm, more preferably 0.1–1.0 mm, and most preferably 0.30–0.85 mm.

The vibration damping material preferably is a viscoelastic material selected from the group consisting of butyl rubbers and synthetic elastomers. Preferably, layer 22 of viscoelastic material has a thickness of no more that 2.0 mm and exhibits an intrinsic damping coefficient between 0.2 and 1.6.

Figure 2:
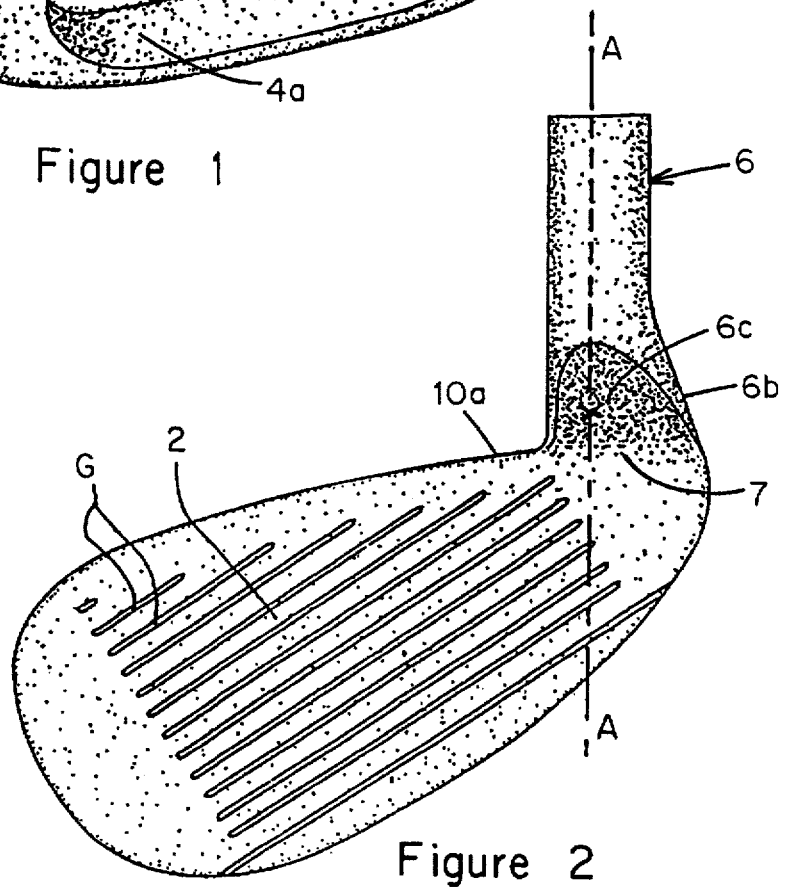
FIG. 2 is a front view of the golf club head shown in FIG. 1.

The inset/offset hosel 6 shown in FIGS. 1–4 is now explained. The amount of inset and offset of hosel 6 is more or less the same as the hosel described in U.S. Pat. No. 5,312,105. However, where the hosel of the '105 patent extends from the face of the club head, hosel 6 of the invention extends generally upwardly and forwardly only from top rail 10. More specifically, top rail 10 is in part formed by perimeter weighting element 4, and includes a top rail surface portion 10a that extends rearwardly from an upper periphery of front striking face 2, and also extends between toe and heel regions of the club head. Hosel 6 extends generally upwardly and forwardly only from heel end portion 7 of top rail surface portion 10a. This arrangement ensures that hosel 6 does not impede contact between a golf ball and any portion of a grooved striking zone defined by substantially longitudinal grooves G extending in the toe-to-heel direction, as shown in FIG. 2. It is preferred that hosel 6 does not occupy any portion of front striking face 2 and thus does not impede contact between any portion of front striking face 2 and a golf ball during impact therebetween.

FIGS. 1–3 show that hosel 6 includes a substantially cylindrical upper segment 6a which has a bore 11 therein for receiving shaft 8. Hosel upper segment 6a terminates above heel end portion 7 of top rail surface portion 10a, and hosel 6 has a lower segment 6b which integrally connects upper segment 6a with the club head. Lower segment 6b has a substantially planar front surface 6c that extends downwardly and rearwardly from upper segment 6a and intersects a downward extension of the axis A—A of hosel bore 11 (FIG. 2). Planar front surface 6c merges smoothly with an upper periphery of front striking face 2, which upper periphery defines the boundary between front striking face 2 and top rail surface portion 10a. FIG. 2 shows that planar front surface 6c is substantially parabolic in shape. This design ensures that the hosel does not occupy any portion of striking face 2, where it would otherwise impede contact between striking face 2 and a golf ball.

The present invention provides a significant improvement in the inset/offset, vibration damped golf clubs of the prior art, in that it maximizes the effect of the vibration damping plaque while facilitating mass production of the club head, and also utilizes the benefits of an inset/offset hosel design without impeding contact between the striking face of the club head and a golf ball.

What is claimed is:

1. A correlated set of iron-type golf club heads, each head comprising:

a substantially planar blade element having a front striking face for impacting a golf ball, and a rear surface opposite said front striking face;

a perimeter weighting element integral with at least a portion of the outer perimeter of said rear surface and extending substantially rearwardly from that outer perimeter, a remainder of said rear surface not covered by said perimeter weighting element defining the bottom of an open cavity, the sides of which are defined by an inner peripheral surface of the perimeter weighting element; and a hosel extending from an upper heel region of the head for connection to a shaft;

wherein the area and shape of said remainder of said rear surface are substantially identical in each club head of the correlated set.

2. The correlated set of iron-type golf club heads of claim 1, wherein the lateral position of the open cavity, relative to an outer peripheral surface of the perimeter weighting element at the same location on the periphery of each club head, is different for each club head of the correlated set.

3. The correlated set of iron-type golf club heads of claim 1, wherein each head has a plaque secured to and covering the entirety of said remainder of said rear surface, and the area and shape of said plaque are substantially identical in each club head of the correlated set.

4. The correlated set of iron-type golf club heads according to claim 3, wherein each plaque comprises vibration damping material.

5. The correlated set of iron-type golf club heads according to claim 4, wherein said vibration damping material is a viscoelastic material selected from the group consisting of butyl rubbers and synthetic elastomers.

6. The correlated set of iron-type golf club heads according to claim 3, wherein each plaque comprises a layer of viscoelastic material secured to the rear surface of each head and a constraining layer secured to said layer of viscoelastic material on each head.

7. The correlated set of iron-type golf club heads according to claim 6, wherein said constraining layer comprises a rigid plate having a Young's modulus of at least 10,000 MPa.

8. The correlated set of iron-type golf club heads according to claim 6, wherein said constraining layer comprises a rigid plate having a Young's modulus of at least 40,000 MPa.

9. The correlated set of iron-type golf club heads according to claim 6, wherein said constraining layer comprises a rigid plate having a Young's modulus of at least 60,000 MPa.

10. The correlated set of iron-type golf club heads according to any one of claims 7–9, wherein said rigid plate has a thickness of about 0.05 to about 2.0 mm.

11. The correlated set of iron-type golf club heads according to claim 6, wherein said constraining layer comprises at least one material selected from the group consisting of aluminum alloys, aluminum-zinc-magnesium alloys, laminated heat-setting materials reinforced with carbon fibers, laminated heat-setting materials reinforced with glass fibers, thermoplastics reinforced with carbon fibers, and thermoplastics reinforced with glass fibers.

12. The correlated set of iron-type golf club heads according to claim 6, wherein said layer of viscoelastic material has a thickness of no more that 2.0 mm and exhibits an intrinsic damping coefficient between 0.2 and 1.6.

13. The correlated set of iron-type golf club heads of claim 1, each head additionally having vibration damping means secured to and covering the entirety of said remainder of said rear surface, said vibration damping means comprising a layer of viscoelastic material secured to said rear surface and a rigid plate secured to said layer of viscoelastic material, said viscoelastic material comprising at least one material selected from the group consisting of butyl rubbers and synthetic elastomers, said rigid plate comprising at least one material selected from the group consisting of aluminum alloys, aluminum-zinc-magnesium alloys, laminated heat-setting materials reinforced with carbon fibers, laminated heat-setting materials reinforced with glass fibers, thermoplastics reinforced with carbon fibers, and thermoplastics reinforced with glass fibers, said rigid plate having a Young's modulus of at least 60,000 MPa and a thickness of about 0.05 to about 2.0 mm.

14. The correlated set of iron-type golf club heads according to any one of claims 1 and 2–13, wherein the perimeter weighting element of each head is substantially ring-shaped and extends around the entire outer perimeter of said rear surface.

15. The correlated set of iron-type golf club heads according to any one of claims 1 and 2–13, wherein a lateral width of the perimeter weighting element of each head, measured in a direction substantially parallel to said blade element at the same location on the periphery of each club head, is different for each club head of the correlated set.

16. The correlated set of iron-type golf club heads according to any one of claims 1 and 2–13, wherein the thickness of said blade element of each head, measured between said front striking face and said remainder of said rear surface, is different for each club head of the correlated set.

17. The correlated set of iron-type golf club heads according to any one of claims 1 and 2–13, wherein the lateral position of the open cavity of each head, relative to an outer peripheral surface of the perimeter weighting element at the same location on the periphery of each club head, is different for each club head of the correlated set.

18. The correlated set of iron-type golf club heads according to any one of claims 1 and 2–13, wherein the inner peripheral surface of the perimeter weighting element of each head is substantially perpendicular to said rear surface.

19. A correlated set of iron-type golf clubs, each comprising a golf club head as defined in any one of claims 1 and 2–13, and each having a shaft connected to the hosel of each club head.

20. The correlated set of iron-type golf club heads according to any one of claims 1 and 2–13, each head additionally comprising a toe portion, a heel portion opposite said toe portion, and a top rail surface portion projecting rearwardly from an upper periphery of said front striking face and extending between said toe and heel portions; and the hosel includes a bore for receiving a shaft, said hosel being offset such that an extension of the axis of the bore intersects the front striking face or an extension of the plane thereof, said hosel being inset such that the axis of the bore is spaced inwardly from the exterior of said heel portion, said hosel extending generally upwardly and forwardly only from the heel end portion of said top rail surface portion such that the hosel does not occupy any portion of the front striking face, and does not impede contact between the front striking face and a golf ball, wherein said hosel comprises a substantially cylindrical upper segment having the bore therein, said hosel upper segment terminating above the heel end of said top rail surface portion and having a lower segment integrally connecting said upper segment with the blade element, said lower segment having a substantially planar front surface, which is substantially parabolic in shape, that extends downwardly and rearwardly from said upper segment intersecting the extension of the axis of the hosel bore, and merging smoothly with an upper periphery of said front striking face.

* * * * *